United States Patent [19]

Takashima

[11] Patent Number: 5,054,438

[45] Date of Patent: Oct. 8, 1991

[54] FLOATING CYLINDER INTERNAL COMBUSTION ENGINE

[76] Inventor: Jiro Takashima, 7203 Schiller, Houston, Tex. 77055

[21] Appl. No.: 585,715

[22] Filed: Sep. 19, 1990

[51] Int. Cl.[5] ..... F02B 59/00

[52] U.S. Cl. ..... 123/50 R; 123/188 C; /

[58] Field of Search ..... 123/50 R, 50 A, 50 B, 123/188 C, 59 AC, 668, 190 CA, 190 C, 193 C, DIG. 7

[56] References Cited

U.S. PATENT DOCUMENTS

| | | | |
|---|---|---|---|
| 1,550,643 | 8/1925 | Bullington | 123/188 C |
| 1,582,195 | 4/1926 | Vallier | 123/188 C |
| 1,635,534 | 7/1927 | Burtnett | 123/188 C |
| 1,764,557 | 6/1930 | Gausel | 123/59 AC |
| 1,778,909 | 10/1930 | Niven | 123/59 AC |
| 1,869,787 | 8/1932 | Trumble | 123/59 AC |
| 2,814,282 | 11/1957 | Gross | 123/188 C |
| 3,191,584 | 6/1965 | Brahler | 123/50 R |
| 4,148,284 | 4/1979 | Prosen | 123/78 C |

*Primary Examiner*—David A. Okonsky
*Attorney, Agent, or Firm*—Harrison & Egbert

[57] ABSTRACT

A two stroke cycle internal combustion engine providing a cylinder movably held within the cylinder block. The ports operation timing is controlled by the longitudinal movement of the cylinder.

1 Claim, 1 Drawing Sheet

FLOATING CYLINDER INTERNAL COMBUSTION ENGINE

BACKGROUND OF THE INVENTION

1. Field of the Invention

This invention is related to the internal combustion engine, more particularly, this invention is related to the two stroke cycle internal combustion engine with variable port timing.

2. Prior Art

Today's two stroke cycle internal combustion engine has several drawbacks, such as excessive exhaust pollutants released in the atmosphere, especially when the engine operates at slower revolutions. Another drawback is lower volumetric efficiency caused by the short duration of the port opening when the engine is operating at higher revolutions. This invention is designed to solve the drawbacks described above.

SUMMARY OF THE INVENTION

An object of this invention is to provide variable port timing attained by the longitudinal movement of the cylinder of which position relative to the piston is adjustable. This makes it possible to properly adjust the port timing to correspond to any revolution of the engine to attain the most efficient scavenging.

DETAILED DESCRIPTION OF THE INVENTION

Figure 1:
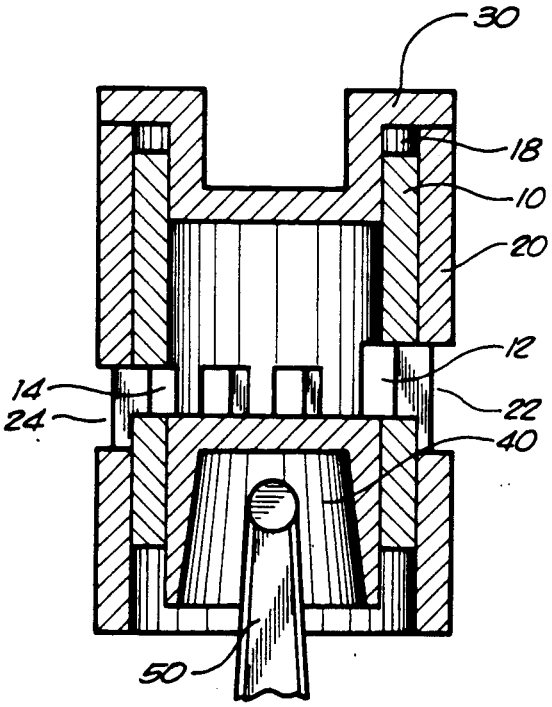
FIG. 1 is a cross sectional view, in side elevation of this invention, showing a cylinder in its topmost position and a piston in its lowermost position.
Figure 2:
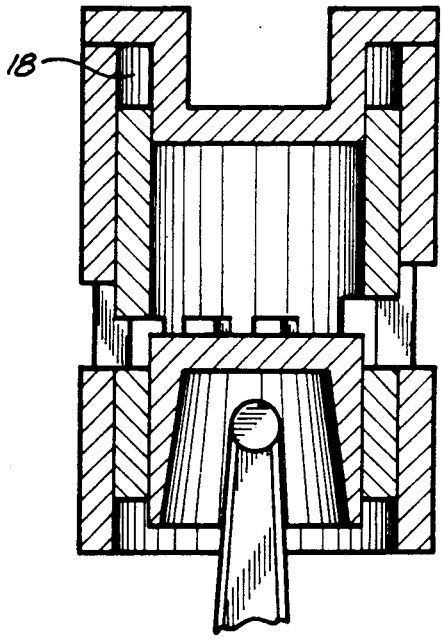
FIG. 2 is a cross sectional view, in side elevation showing the cylinder in its lowermost position and the piston in its lowermost position.

Referring to the drawings, the top of the cylinder block 20 is attached to the reentrant cylinder head 30 to form the annular recess 18. The cylinder 10 is slidably held within the cylinder block, and the top portion of the cylinder is sealingly positioned within the annular recess 18. The piston 40 is slidably held within the cylinder by a connecting rod 50. The cylinder has the intake port 14 and the exhaust port 12 in its lower portion of the wall. The position of the cylinder can be controlled longitudinally. The port timing depends on the distance from the cylinder head to the port; that is, the shorter the distance between them, the more advanced the port opening and the more delayed the port closing. When the engine operates at its highest revolution, the cylinder is positioned at its topmost position (as shown in FIG. 1) in order to achieve longest port opening duration. When the engine operates at its lowest revolution, the cylinder is positioned at its lowermost position (as shown in FIG. 2) in order to achieve shortest port opening duration. The cylinder block has the exhaust passage 22 and the intake passage 24 communicating with the exhaust port 12 and the intake port 14 respectively.

Figure 3:
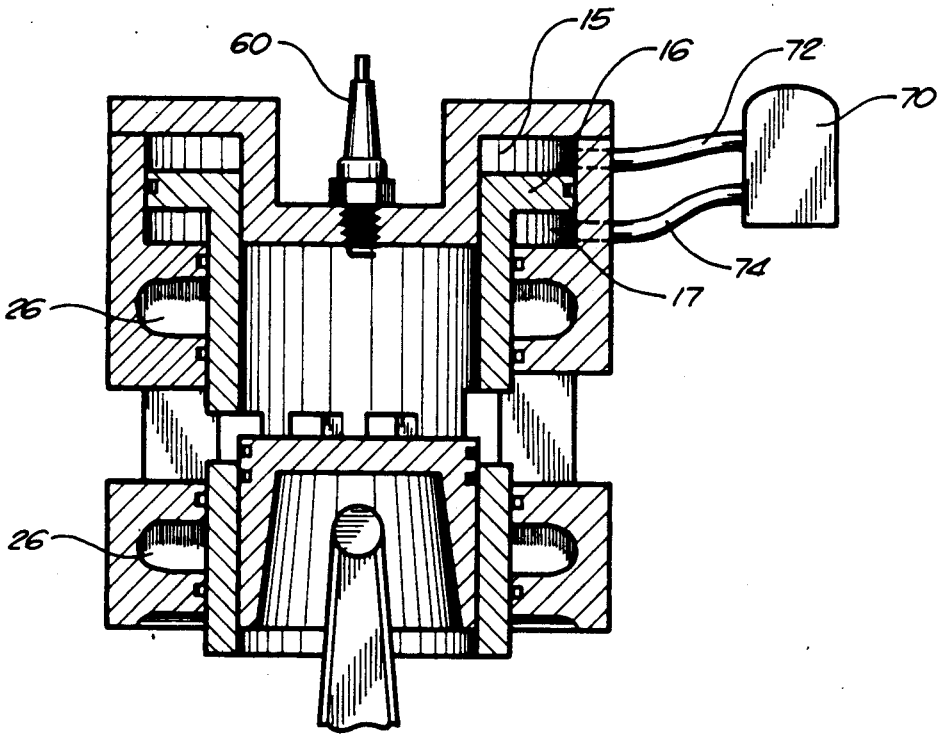
FIG. 3 is a cross sectional view, in side elevation showing the cylinder in its middle position and the piston in its lowermost position.

FIG. 3 shows one embodiment of this invention. The cylinder has the flange 16 which separates the space of the annular recess 18 into two chambers, upper annular chamber 15 and lower annular chamber 17. Both of the chambers are filled with fluid. The position of the cylinder can be controlled by changing the ratio of the volume of fluid between chamber 15 and chamber 17. This ratio is controlled by the cylinder positioner/adjuster 70 through the supply tubes 72 and 74. The spark plug 60 is attached to the reentrant cylinder head. A cooling chamber 26 surrounds the cylinder.

I claim:

1. A floating cylinder internal combustion engine comprising:

a slidable having an intake port and an exhaust port;

a reentrant cylinder head connected to a cylinder block, said cylinder block having an intake passage and an exhaust passage communicating with said intake port and said exhaust port respectively, said intake passage and said exhaust passage formed in said cylinder block having a longitudinal dimension with respect to the cylinder axis of greater length than a longitudinal dimension with respect to the cylinder axis of said intake port and said exhaust port, said cylinder slidably positioned inside said cylinder block, said cylinder having a top portion slidably positioned within an annular recess between said reentrant cylinder head and said cylinder block;

a piston slidably positioned within said cylinder; and a port timing control means interactive with said cylinder for adjusting a position of said intake port and said exhaust port during movement of said piston with respect to the longitudinal dimension of said intake passage and said exhaust passage, said port timing control means causing said cylinder to move independently with respect to the movement of said piston within said cylinder.

* * * * *